US010124243B1

(12) United States Patent
Baugh

(10) Patent No.: US 10,124,243 B1
(45) Date of Patent: Nov. 13, 2018

(54) WORD-FORMING GAME

(71) Applicant: Kenneth Baugh, Pleasanton, KS (US)

(72) Inventor: Kenneth Baugh, Pleasanton, KS (US)

( * ) Notice: Subject to any disclaimer, the term of this patent is extended or adjusted under 35 U.S.C. 154(b) by 0 days.

(21) Appl. No.: 15/437,535

(22) Filed: Feb. 21, 2017

(51) Int. Cl.

| | |
|---|---|
| ***A63F 3/00*** | (2006.01) |
| ***A63F 1/02*** | (2006.01) |
| ***A63F 9/20*** | (2006.01) |
| ***A63F 3/04*** | (2006.01) |
| ***A63F 11/00*** | (2006.01) |

(52) U.S. Cl.
CPC ..... *A63F 3/0423* (2013.01); *A63F 3/00694* (2013.01); *A63F 11/0011* (2013.01); *A63F 2250/601* (2013.01)

(58) Field of Classification Search
USPC ..... 273/240–293
See application file for complete search history.

(56) References Cited

U.S. PATENT DOCUMENTS 176,144 A * 4/1876 McDougall ..... A63F 9/0098 184/38.3
1,162,629 A * 11/1915 Mager ..... G09B 17/00 273/272
D58,069 S * 6/1921 Carter ..... 273/236
1,553,835 A * 9/1925 Peters ..... A63F 3/0423 273/272
1,633,445 A * 6/1927 Gail ..... A63F 3/0423 273/272
2,055,159 A * 9/1936 Scofield ..... A63F 3/0423 273/153 R
D111,848 S * 10/1938 Danon ..... D21/349
D122,253 S * 9/1940 Bradley ..... D21/349
2,320,832 A * 6/1943 Schoenberg ..... A63F 3/0415 273/242
D141,092 S * 5/1945 Deschneau ..... D21/350
2,743,108 A * 4/1956 Sanders ..... A63F 3/06 273/269
2,752,158 A * 6/1956 Brunot ..... A63F 3/0415 273/272
2,757,934 A * 8/1956 Dunbar ..... A63F 3/0423 273/272
2,811,361 A * 10/1957 Woolrich, Jr. ..... A63F 3/00088 273/142 R
3,016,243 A * 1/1962 Irwin ..... A63F 1/00 273/157 A
3,152,806 A * 10/1964 Jackman ..... A63F 3/0423 221/171
3,224,114 A * 12/1965 Swanson ..... A63F 3/0415 273/157 R (Continued)

*Primary Examiner* — Alvin Hunter

(57) ABSTRACT

The word-forming game is a board game comprising a coordinate board, a plurality of tiles, and a randomizing device. The coordinate board comprises a plurality of columns, a plurality of rows, and a plurality of cells. Each cell is identified by the intersection of a selected column and a selected row. Each of the plurality of tiles contains a letter. A portion of the plurality of tiles are distributed between each of the plurality of players. The balance of the tiles are positioned at previously selected cells. Each player uses a randomizing device to select a cell. If a tile is located on the selected cell, the player takes the tile. If a tile is not located on the selected cell, the player places a tile on the selected cell. The first player that completes a five letter word is declared the winner of the game.

7 Claims, 3 Drawing Sheets

(56) References Cited

U.S. PATENT DOCUMENTS 3,267,590 A 8/1966 Browning
3,342,493 A * 9/1967 Lang ..... A63F 3/0415 273/271
3,394,471 A * 7/1968 Holten ..... A63F 3/0423 273/273
3,565,439 A * 2/1971 Krouse ..... A63F 3/0423 273/142 R
3,606,336 A * 9/1971 Krause ..... A63F 3/0423 273/272
3,674,274 A * 7/1972 Schur ..... A63F 3/00 273/241
3,779,557 A * 12/1973 Kritzberg ..... A63F 3/0423 273/272
3,820,791 A * 6/1974 Powers ..... A63F 3/00697 273/258
D232,949 S * 9/1974 Murphy ..... 273/236
4,043,559 A * 8/1977 Eigen ..... A63F 3/0457 273/236
4,043,560 A 8/1977 Blackman
D248,884 S * 8/1978 Foxworthy ..... D21/350
4,129,304 A * 12/1978 Mager ..... A63F 3/00157 273/242
4,131,282 A * 12/1978 Boyer ..... A63F 3/00 273/271
D251,322 S * 3/1979 Weiss ..... D21/349
D259,728 S * 6/1981 Laws ..... D21/350
4,289,314 A * 9/1981 Berlino ..... A63F 3/0423 273/260
4,306,724 A * 12/1981 Brzezinski ..... A63F 3/0423 273/243
D262,724 S * 1/1982 Santee ..... D21/351
4,341,387 A * 7/1982 Freyman ..... A63F 3/0423 273/240
D265,840 S * 8/1982 Campos ..... D21/349
4,365,813 A 12/1982 Hirsch
4,448,423 A 5/1984 Augusta
4,468,035 A * 8/1984 Slepian ..... A63F 3/0423 273/243
4,565,374 A * 1/1986 Pak ..... A63F 3/0415 273/272
4,591,161 A * 5/1986 Vanderhoof ..... A63F 3/0423 273/272
4,705,276 A * 11/1987 Kastle ..... A63F 3/00895 108/54.1
4,834,390 A * 5/1989 Phillips ..... A63F 3/00895 248/185.1
4,842,281 A * 6/1989 Turner ..... A63F 3/00072 273/256
4,892,319 A * 1/1990 Johnson, II ..... A63F 3/0423 273/146
4,903,969 A * 2/1990 Williams, Jr. ..... A63F 3/00097 273/248
D313,249 S * 12/1990 Klinger ..... D21/365
5,127,656 A * 7/1992 Simpson ..... A63F 1/04 273/269
5,257,787 A * 11/1993 Miccio ..... A63F 3/02 273/260
5,332,229 A * 7/1994 Fielder ..... A63F 3/00 273/264
5,377,992 A * 1/1995 Audet ..... A63F 1/04 273/269
5,413,350 A * 5/1995 Taylor ..... A63F 3/00643 273/269
5,429,371 A * 7/1995 Bledsoe ..... A63F 3/0423 273/243
5,445,390 A * 8/1995 Dutton ..... A63F 3/0415 273/243
5,520,394 A * 5/1996 Brueckner ..... A63F 3/0423 273/272
5,536,014 A * 7/1996 Serfozo ..... A63F 3/02 273/260
5,566,942 A * 10/1996 Elum ..... A63F 3/0423 273/153 R
5,601,288 A * 2/1997 White ..... A63F 3/00 273/271
5,794,933 A * 8/1998 Chalfin ..... A63F 3/0423 273/272
5,918,883 A * 7/1999 McKenzie ..... A63F 3/02 273/264
6,325,374 B1 * 12/2001 Burger ..... A63F 3/00 273/236
6,474,643 B1 * 11/2002 Rehus ..... A63F 3/00075 273/244
6,536,766 B1 3/2003 Deitch
6,769,692 B1 * 8/2004 Cavalluzzo ..... A63F 3/0423 273/272
7,000,919 B2 * 2/2006 LiDonnici ..... A63F 3/0423 273/153 R
7,216,868 B2 * 5/2007 Groz ..... A63F 3/0423 273/272
7,267,340 B2 * 9/2007 Hyra ..... A63F 3/04 273/272
7,275,746 B2 * 10/2007 Jensen ..... A63F 3/04 273/153 R
7,591,469 B2 * 9/2009 Dowe ..... A63F 3/0423 273/272
7,806,406 B1 * 10/2010 Simikic ..... A63F 3/00006 273/243
8,360,780 B2 * 1/2013 Barton ..... G09B 19/02 273/139
8,528,906 B1 * 9/2013 Heaslip ..... A63F 3/0423 273/243
D693,413 S * 11/2013 Miller ..... D21/349
D713,891 S 9/2014 Schwartz
2009/0045574 A1 2/2009 Quinlan

* cited by examiner

WORD-FORMING GAME

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of sports, games, and amusements, more specifically, a word-forming board game.

SUMMARY OF INVENTION

The word-forming game is a board game. The word-forming game is played by a plurality of players. The objective of the game is to be the first player to spell a five letter word. Each of the plurality of players alternate turns such that each player will have taken one turn before any of the plurality of players takes a second turn. The word-forming game comprises a coordinate board, a plurality of tiles, and a randomizing device. The coordinate board further comprises a plurality of columns, a plurality of rows, and a plurality of cells. Each cell selected from the plurality of cells is formed at, and is identified by, the intersection of a column selected from the plurality of columns and a row selected from the plurality of rows. Each of the plurality of tiles contains a letter. The each of the balance of the tiles remaining in the plurality of tiles is positioned at a cell selected from the plurality of cells. At each turn, the player uses the randomizing device to select a cell from the plurality of cells. If a tile is located on the selected cell, the player retrieves the tile and the turn rotates to the next player. If a tile is not located on the selected cell, the player is obligated to place a tile from the player's invention on the selected cell. The first player that completes a five letter word in either a row selected from the plurality of rows or a column selected from the plurality of columns is declared the winner of the game.

These together with additional objects, features and advantages of the word-forming game will be readily apparent to those of ordinary skill in the art upon reading the following detailed description of the presently preferred, but nonetheless illustrative, embodiments when taken in conjunction with the accompanying drawings.

In this respect, before explaining the current embodiments of the word-forming game in detail, it is to be understood that the word-forming game is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the word-forming game.

It is therefore important that the claims be regarded as including such equivalent construction insofar as they do not depart from the spirit and scope of the word-forming game. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

Figure 1:
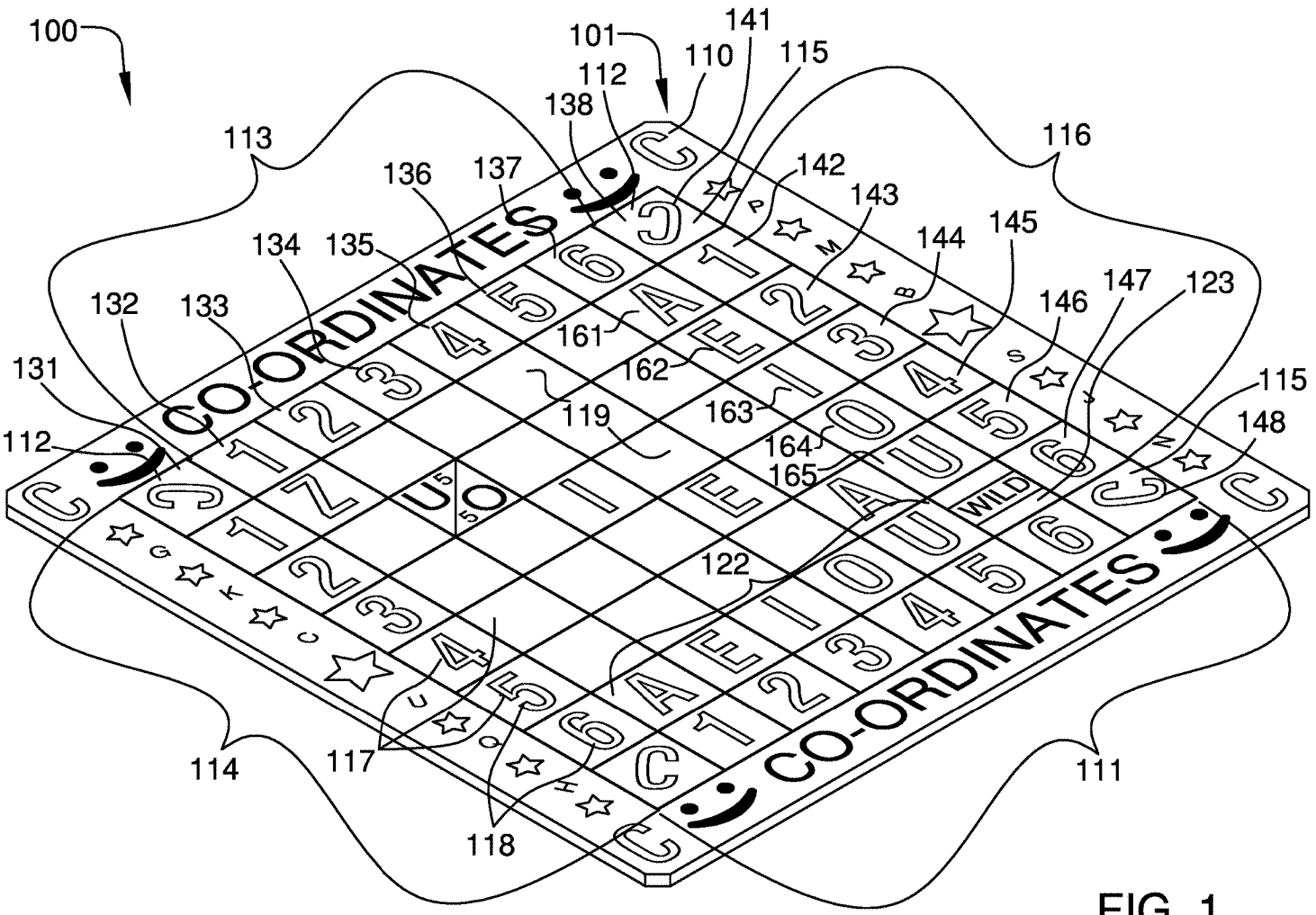
FIG. 1 is a perspective view of an embodiment of the disclosure.
Figure 2:
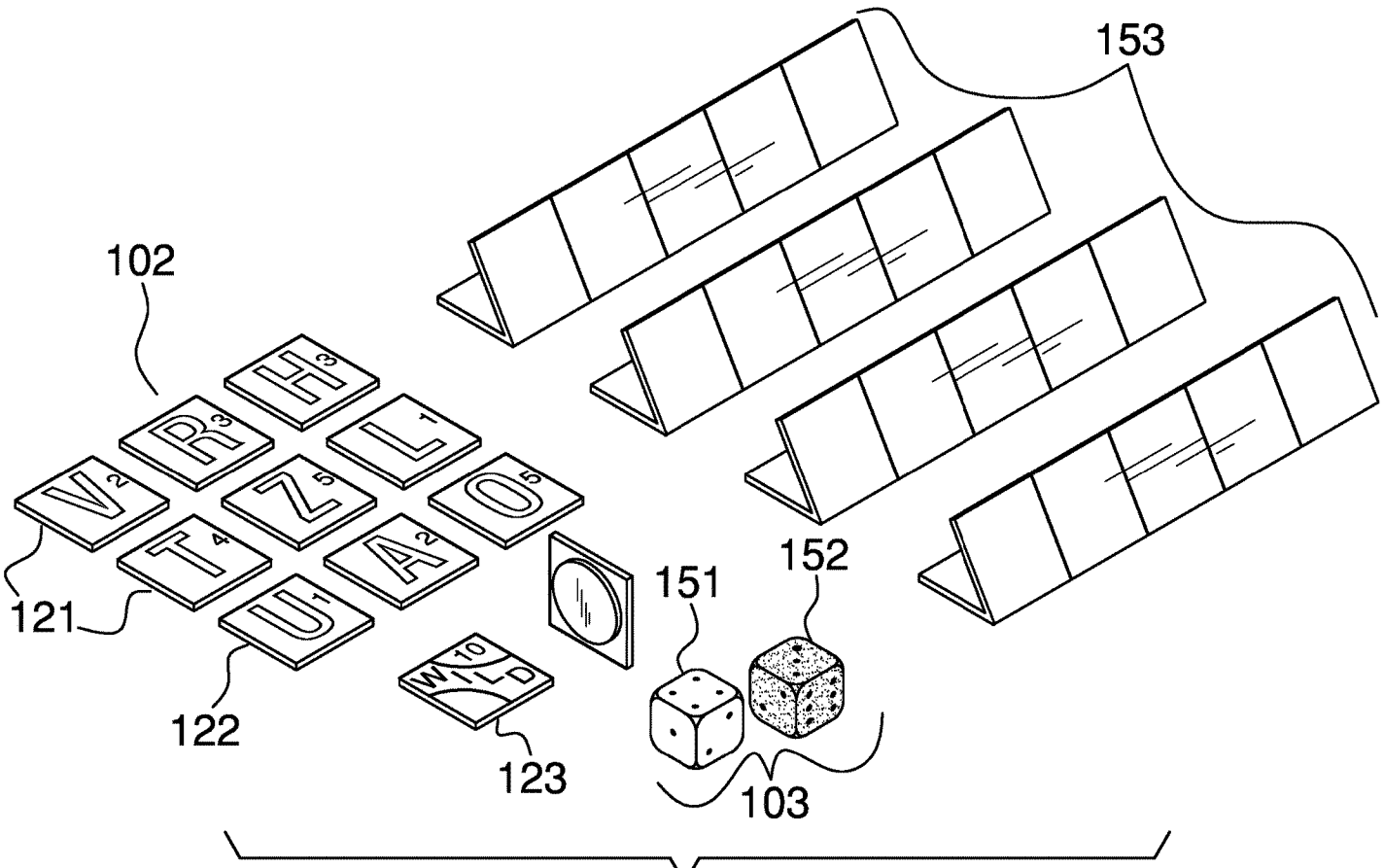
FIG. 2 is a detail view of an embodiment of the disclosure.
Figure 3:
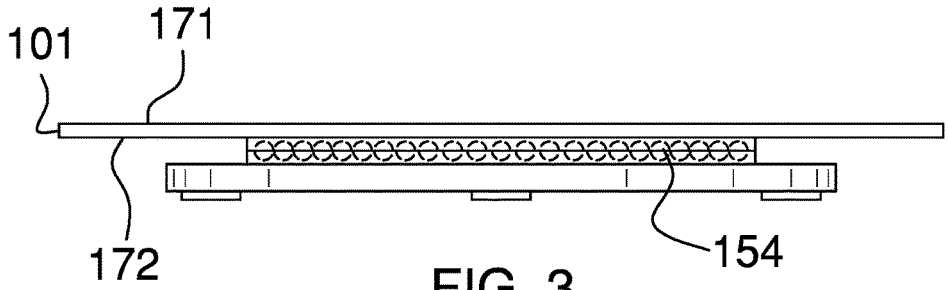
FIG. 3 is a side view of an embodiment of the disclosure.
Figure 4:
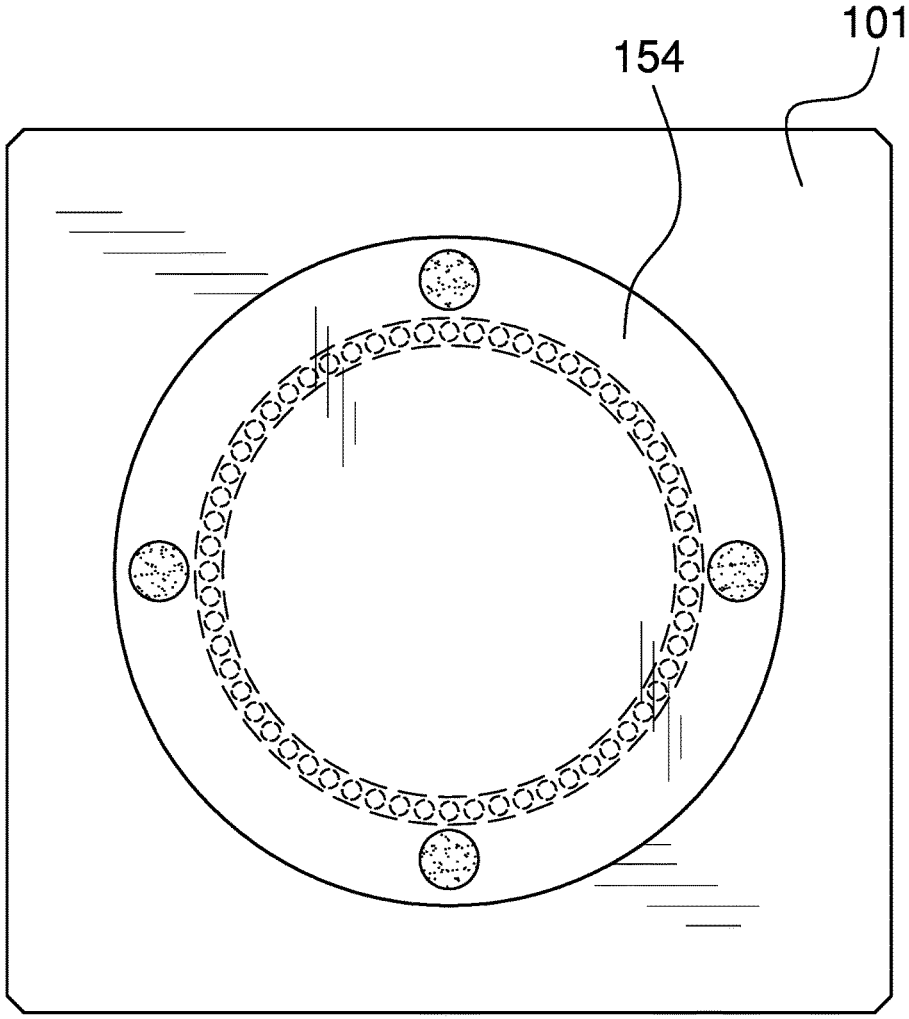
FIG. 4 is a bottom view of an embodiment of the disclosure.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Detailed reference will now be made to one or more potential embodiments of the disclosure, which are illustrated in FIGS. 1 through 4.

The word-forming game 100 (hereinafter game) is a board game 100. The game 100 is played by a plurality of players. The objective of the game 100 is to be the first player to spell a five letter word. Each of the plurality of players alternate turns such that each player will have taken one turn before any of the plurality of players take a second turn. The game 100 comprises a coordinate board 101, a plurality of tiles 102, and a randomizing device 103. The coordinate board 101 further comprises a plurality of columns 111, a plurality of rows 114, and a plurality of cells 117. Each cell selected from the plurality of cells 117 is formed at, and is identified by, the intersection of a column selected from the plurality of columns and a row selected from the plurality of rows 114. Each of the plurality of tiles 102 contains a letter.

All of the tiles remaining in the plurality of tiles 102 is positioned at a cell selected from the plurality of cells 117. At each turn, the player uses the randomizing device 103 to select a cell from the plurality of cells 117. If a tile is located on the selected cell, the player retrieves the tile and the turn rotates to the next player. If a tile is not located on the selected cell, the player is obligated to place a tile from the player's tile inventory on the selected cell. The turn then rotates to the net player. The first player that completes a five letter word in either a row selected from the plurality of rows 114 or a column selected from the plurality of columns 111 is declared the winner of the game 100. In a second potential embodiment of the disclosure, the game 100 further comprises a plurality of stands 153 and a turntable 154. The turntable 154 attaches to the coordinate board 101 such that the coordinate board 101 can be rotated to face each player during a turn. The plurality of stands 153 is an apparatus that holds tiles selected from the plurality of tiles 102 in such a manner that each tile placed on a stand selected form the plurality of stands 153 is only visible to one player selected from the plurality of players.

The coordinate board 101 is a flat panel that acts as the board upon which the game 100 is played.

The coordinate board 101 comprises a panel 110. The panel 110 forms a flat rectangular surface, which is used to facilitate and organize game 100 play. The panel 110 is further defined with a playing surface 171 and a rotating surface 172. The rotating surface 172 is proximal to the supporting surface upon which the coordinate board 101 is placed. The playing surface 171 is distal from the rotating surface 172. As shown most clearly in FIG. 1, the panel 110 is further organized into a plurality of columns 111, a plurality of rows 114, and a plurality of cells 117 that combine to form a grid pattern on the panel 110. The plurality of columns 111, the plurality of rows 114, and the plurality of cells 117 are formed on the playing surface 171. Each cell selected from the plurality of cells 117 is defined as a region formed by an intersection of a column selected from the plurality of columns 111 and a row selected from the plurality of rows 114.

The plurality of columns 111 are defined as a plurality of parallel rectangular regions that are drawn upon the panel 110. In the first potential embodiment of the disclosure, the plurality of columns 111 comprises a first column 131, a second column 132, a third column 133, a fourth column 134, a fifth column 135, a sixth column 136, a seventh column 137, and an eighth column 138.

The plurality of columns 111 are organized into a plurality of marker columns 112 and a plurality of playing columns 113. The plurality of marker columns 112 is a subset of columns selected from the plurality of columns 111 that are used to designate and identify the regions of the coordinate board 101. The plurality of playing columns 113 is a subset of columns selected from the plurality of columns 111 that are used to form the playing space regions of the coordinate board 101.

In the first potential embodiment of the disclosure, the plurality of marker columns 112 comprises the first column 131 and the eighth column 138. The plurality of playing columns 113 comprises the second column 132, the third column 133, the fourth column 134, the fifth column 135, the sixth column 136, and the seventh column 137.

The plurality of rows 114 are defined as a plurality of parallel rectangular regions that are drawn upon the panel 110. The sense of direction of the plurality of rows 114 is perpendicular to the sense of direction of the plurality of columns 111. In the first potential embodiment of the disclosure, the plurality of rows 114 comprises a first row 141, a second row 142, a third row 143, a fourth row 144, a fifth row 145, a sixth row 146, a seventh row 147, and an eighth row 148.

The plurality of rows 114 are organized into a plurality of marker rows 115 and a plurality of playing rows 116. The plurality of marker rows 115 is a subset of rows selected from the plurality of rows 114 that are used to designate and identify the regions of the coordinate board 101. The plurality of playing rows 116 is a subset of rows selected from the plurality of rows 114 that are used to form the playing space regions of the coordinate board 101.

In the first potential embodiment of the disclosure, the plurality of marker rows 115 comprises the first row 141 and the eighth row 148. The plurality of playing rows 116 comprises the second row 142, the third row 143, the fourth row 144, the fifth row 145, the sixth row 146, and the seventh row 147.

The plurality of cells 117 are defined as a plurality of parallel rectangular regions that are drawn upon the panel 110. Each cell selected from the plurality of cells 117 is defined as the region formed by an intersection of a column selected from the plurality of columns 111 and a row selected from the plurality of rows 114. The plurality of cells 117 are organized into a plurality of marker cells 118 and a plurality of playing cells 119. The plurality of marker cells 118 is a subset of cells selected from the plurality of cells 117 that are used to designate and identify the regions of the coordinate board 101. The plurality of playing cells 119 is a subset of cells selected from the plurality of cells 117 that are used to form the playing space regions of the coordinate board 101.

In the first potential embodiment of the disclosure, the plurality of marker cells 118 include all the cells contained within the first column 131, all the cells contained within the eighth column 138, all the cells contained within the first row 141, and all the cells contained within the eighth row 148. The plurality of cells 117 that are not contained within the plurality of marker cells 118 are contained within the plurality of playing cells 119.

In a second potential embodiment of the disclosure, the coordinate board 101 further comprises a turntable 154. The turntable 154 is a slewing bearing that is mounted on the rotating surface 172 of the panel 110. The turntable 154 is used to rotate the coordinate board 101 during play.

Each of the plurality of tiles 102 is a rectangular plate structure upon which symbols are printed. Each of the plurality of tiles 102 are sized such that any selected tile will fit within the boundary of any cell selected from the plurality of cells 117.

The tiles contained within the plurality of tiles 102 are further organized into a plurality of consonant tiles 121, a plurality of vowel tiles 122 and a wild card tile 123. The plurality of consonant tiles 121 is a rectangular plate structure upon which a consonant selected from the English alphabet is displayed. The plurality of vowel tiles 122 is a rectangular plate structure upon which a vowel selected from the English alphabet is displayed. The wild card tile 123 is a rectangular plate structure upon which the phrase "wild card" is displayed. During game 100 play a player is provided an opportunity to declare what letter the wild card tile 123 represents.

In the first potential embodiment of the disclosure, the plurality of tiles 102 comprises 36 tiles. The plurality of vowel tiles 122 comprises 3 tiles that have the letter A 161 printed on it, 3 tiles that have the letter E 162 printed on it, 3 tiles that have the letter I 163 printed on it, 3 tiles that have the letter O 164 printed on it, two tiles that have the letter U 165 printed on it, and 1 tile has a U/O printed on it. Within this disclosure, the letter A 161 refers to the first letter of the English alphabet. The letter E 162 refers to the fifth letter of the English alphabet. The letter I 163 refers to the ninth letter of the English alphabet. The letter O 164 refers to the fifteenth letter of the English alphabet. The letter U 165 refers to the twenty first letter of the English alphabet. The plurality of consonant tiles 121 comprises 20 tiles. Each tile selected from the plurality of consonant tiles 121 has printed on it a consonant selected from the alphabet. The wild card tile 123 is the $36^{th}$ tile.

The randomizing device 103 consists of a mechanical device that is used to generate a first random number and a second random number. Moreover, the randomizing device 103 consists of a red die and a green die. The first random number is used to select a playing column contained within the plurality of playing columns 113 while the second random number is used to select a playing row from the plurality of playing rows 116. The intersection of the selected playing column and the selected playing row identifies a cell selected from the plurality of playing cells 119 from which or to which a tile selected from the plurality of tiles 102 will be removed or added.

In the first potential embodiment of the disclosure, the randomizing device 103 comprises a first die 151 and a second die 152. The first die 151 is a readily and commercially available randomizing device 103 that comprises a six sided cube. Each face of the cube is formed with a different number of spots that designate the numbers 1 through 6. When the first die 151 is thrown the number of spots applied to the side of the first die 151 that is distal from the supporting surface is used to designate a randomly generated number that is generally selected from the numbers ranging from 1 to 6 inclusive. The second die 152 is a second die that is identical to, and used in the same manner, as the first die 151.

In the second potential embodiment of the disclosure, the game 100 further comprises a plurality of stands 153. Each of the plurality of stands 153 is a pedestal upon which each of the plurality of tiles 102 such that the tiles placed on the plurality of stands 153 are visible to one player selected from the plurality of players but are not visible to the remaining players contained within the plurality of players.

The regions of the coordinate board 101 are organized as described in the following five paragraphs.

The cell at the intersection of the first column 131 and the first row 141 has a decorative element printed on it. The cell at the intersection of the eighth column 138 and the first row 141 has a decorative element printed on it. The cell at the intersection of the first column 131 and the eighth row 148 has a decorative element printed on it. The cell at the intersection of the eighth column 138 and the eighth row 148 has a decorative element printed on it.

The symbol on the cell at the intersection of the second column 132 and the first row 141 is a number that designates the location of a first playing column selected from the plurality of playing columns 113. The cell at the intersection of the third column 133 and the first row 141 is a number that designates the location of a second playing column selected from the plurality of playing columns 113. The cell at the intersection of the fourth column 134 and the first row 141 is a number that designates the location of a third playing column selected from the plurality of playing columns 113. The cell at the intersection of the fifth column 135 and the first row 141 is a number that designates the location of a fourth playing column selected from the plurality of playing columns 113. The cell at the intersection of the sixth column 136 and the first row 141 is a number that designates the location of a fifth playing column selected from the plurality of playing columns 113. The cell at the intersection of the seventh column 137 and the first row 141 is a number that designates the location of a sixth playing column selected from the plurality of playing columns 113.

The cell at the intersection of the second column 132 and the eighth row 148 is a number that designates the location of a first playing column selected from the plurality of playing columns 113. The cell at the intersection of the third column 133 and the eighth row 148 is a number that designates the location of a second playing column selected from the plurality of playing columns 113. The cell at the intersection of the fourth column 134 and the eighth row 148 is a number that designates the location of a third playing column selected from the plurality of playing columns 113. The cell at the intersection of the fifth column 135 and the eighth row 148 is a number that designates the location of a fourth playing column selected from the plurality of playing columns 113. The cell at the intersection of the sixth column 136 and the eighth row 148 is a number that designates the location of a fifth playing column selected from the plurality of playing columns 113. The cell at the intersection of the seventh column 137 and the eighth row 148 is a number that designates the location of a sixth playing column selected from the plurality of playing columns 113.

The cell at the intersection of the second row 142 and the first column 131 is a number that designates the location of a first playing row selected from the plurality of playing rows 116. The cell at the intersection of the third row 143 and the first column 131 is a number that designates the location of a second playing row selected from the plurality of playing rows 116. The cell at the intersection of the fourth row 144 and the first column 131 is a number that designates the location of a third playing row selected from the plurality of playing rows 116. The cell at the intersection of the fifth row 145 and the first column 131 is a number that designates the location of a fourth playing row selected from the plurality of playing rows 116. The cell at the intersection of the sixth row 146 and the first column 131 is a number that designates the location of a fifth playing row selected from the plurality of playing rows 116. The cell at the intersection of the seventh row 147 and the first column 131 is a number that designates the location of a sixth playing row selected from the plurality of playing rows 116.

The cell at the intersection of the second row 142 and the eighth column 138 is a number that designates the location of a first playing row selected from the plurality of playing rows 116. The cell at the intersection of the third row 143 and the eighth column 138 is a number that designates the location of a second playing row selected from the plurality of playing rows 116. The cell at the intersection of the fourth row 144 and the eighth column 138 is a number that designates the location of a third playing row selected from the plurality of playing rows 116. The cell at the intersection of the fifth row 145 and the eighth column 138 is a number that designates the location of a fourth playing row selected from the plurality of playing rows 116. The cell at the intersection of the sixth row 146 and the eighth column 138 is a number that designates the location of a fifth playing row selected from the plurality of playing rows 116. The cell at the intersection of the seventh row 147 and the eighth column 138 is a number that designates the location of a sixth playing row selected from the plurality of playing rows 116.

As shown most clearly in FIG. 1, to initially set the game 100 up for play, the plurality of vowel tiles 122 and the wild card tile 123 are positioned in the following cells of the coordinate board 101. The initial set up of the game 100 is described in the following three paragraphs.

The cell at the intersection of the seventh column 137 and the second row 142 receives a tile selected from the plurality of vowel tiles 122 that contains the letter A 161. The cell at the intersection of the seventh column 137 and the third row 143 receives a tile selected from the plurality of vowel tiles 122 that contains the letter E 162. The cell at the intersection of the seventh column 137 and the fourth row 144 receives a tile selected from the plurality of vowel tiles 122 that contains the letter I 163. The cell at the intersection of the seventh column 137 and the fifth row 145 receives a tile selected from the plurality of vowel tiles 122 that contains the letter O 164. The cell at the intersection of the seventh column 137 and the sixth row 146 receives a tile selected from the plurality of vowel tiles 122 that contains the letter U 165.

The cell at the intersection of the seventh row 147 and the second column 132 receives a tile selected from the plurality of vowel tiles 122 that contains the letter A 161. The cell at the intersection of the seventh row 147 and the third column 133 receives a tile selected from the plurality of vowel tiles 122 that contains the letter E 162. The cell at the intersection of the seventh row 147 and the fourth column 134 receives a tile selected from the plurality of vowel tiles 122 that contains the letter I 163. The cell at the intersection of the seventh row 147 and the fifth column 135 receives a tile selected from the plurality of vowel tiles 122 that contains the letter O 164. The cell at the intersection of the seventh row 147 and the sixth column 136 receives a tile selected from the plurality of vowel tiles 122 that contains the letter U 165.

The cell at the intersection of the seventh column 137 and the seventh row 147 receives the wild card tile 123.

As an example, a cell of the second column 132 intersects a cell of the second row 142, receives a "Z" tile. A cell of the third column 133 intersects a cell of the third row 143, receives a "U/O" tile. A cell of the fourth column 134 intersects a cell of the fourth row 144, receives an "I" tile. A cell of the fifth column 135 intersects a cell of the fifth row 145, receives an "E" tile. A cell of the sixth column 136 intersects a cell of the sixth row 146, receives an "A" tile.

During the play the game 100, the plurality of players alternate turns such that each player plays a first turn before any player selected from the plurality of players plays a second turn. The order of play of a turn is as follows: 1) the number indicated by the first selected die represents a column selected from the plurality of playing columns 113; 2) the number indicated by the second selected die represents a row selected from the plurality of playing rows 116; 3) the player selects the cell from the plurality of playing cells 119 that is identified by the selected column and the selected row; 4) if the selected cell is occupied by a first tile selected from the plurality of tiles 102, the player removes the tile from the board; 5) if a tile is not located at the selected cell, the player places the first tile selected from the from the plurality of tiles 102 on the selected cell from their tiles. The turn then rotates to the next player.

The first player to compete a word of five letters or more in a row selected from the plurality of playing rows 116 or in a column selected from the plurality of playing columns 113 is declared a winner. It shall be noted that if a player creates a six-letter word, the total value is then doubled.

It shall be noted that the tiles and the board may include fasteners in the form of nylon hook and loop strips, or magnets and metals to attract the components together.

The following definitions were used in this disclosure:

Slewing Bearing: As used in this disclosure, a slewing bearing is a device that is used to rotate an object on a horizontal surface. Slewing bearings are often called turntable bearings or a lazy Susan bearing.

With respect to the above description, it is to be realized that the optimum dimensional relationship for the various components of the invention described above and in FIGS. 1 through 4 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A game comprising:

a coordinate board, a plurality of tiles, and a randomizing device;

wherein the objective of the game is to spell a word of five letters or longer;

wherein the coordinate board further comprises a plurality of columns, a plurality of rows, and a plurality of cells;

wherein each cell selected from the plurality of cells is formed at, and is identified by, the intersection of a column selected from the plurality of columns and a row selected from the plurality of rows;

wherein each of the plurality of tiles contains a letter;

wherein the balance of the tiles are positioned at a cell selected from the plurality of cells;

wherein the coordinate board comprises a flat panel that forms a rectangular surface which is used to facilitate and organize game play;

wherein the panel is further defined with a playing surface and a rotating surface;

wherein the panel is further organized into a plurality of columns, a plurality of rows, and a plurality of cells that combine to form a grid pattern on the panel;

wherein the plurality of columns, the plurality of rows, and the plurality of cells are formed on the playing surface;

wherein the plurality of columns are defined as a plurality of parallel rectangular regions that are displayed upon the panel;

wherein the plurality of rows are defined as a plurality of parallel rectangular regions that are displayed upon the panel;

wherein the sense of direction of the plurality of rows is perpendicular to the sense of direction of the plurality of columns;

wherein each cell selected from the plurality of cells is defined as a region formed by an intersection of a column selected from the plurality of columns and a row selected from the plurality of rows;

wherein the plurality of columns are organized into a plurality of marker columns and a plurality of playing columns;

wherein the plurality of marker columns is a subset of columns selected from the plurality of columns that are used to designate and identify the regions of the coordinate board;

wherein the plurality of playing columns is a subset of columns selected from the plurality of columns that are used to form the playing space regions of the coordinate board;

wherein the plurality of rows are organized into a plurality of marker rows and a plurality of playing rows;

wherein the plurality of marker rows is a subset of rows selected from the plurality of rows that are used to designate and identify the regions of the coordinate board;

wherein the plurality of playing rows is a subset of rows selected from the plurality of rows that are used to form the playing space regions of the coordinate board;

wherein the plurality of columns comprises a first column, a second column, a third column, a fourth column, a fifth column, a sixth column, a seventh column, and an eighth column;

wherein the plurality of marker columns comprises the first column and the eighth column;

wherein the plurality of playing columns comprises the second column, the third column, the fourth column, the fifth column, the sixth column, and the seventh column;

wherein the plurality of rows comprises a first row, a second row, a third row, a fourth row, a fifth row, a sixth row, a seventh row, and an eighth row;

wherein in the first potential embodiment of the disclosure, the plurality of marker rows comprises the first row and the eighth row;

wherein the plurality of playing rows comprises the second row, the third row, the fourth row, the fifth row, the sixth row, and the seventh row;

wherein the plurality of cells are defined as a plurality of parallel rectangular regions that are displayed upon the panel;

wherein the plurality of cells are organized into a plurality of marker cells and a plurality of playing cells;

wherein the plurality of marker cells is a subset of cells selected from the plurality of cells that are used to designate and identify the regions of the coordinate board;

wherein the plurality of playing cells is a subset of cells selected from the plurality of cells that are used to form the playing space regions of the coordinate board;

wherein the plurality of marker cells include all the cells contained within the first column, all the cells contained within the eighth column, all the cells contained within the first row, and all the cells contained within the eighth row;

wherein each of the plurality of cells that are not contained within the plurality of marker cells are contained within the plurality of playing cells;

wherein each of the plurality of tiles is a rectangular plate structure upon which symbols are displayed;

wherein each of the plurality of tiles are sized such that any selected tile will fit within the boundary of any cell selected from the plurality of cells;

wherein the tiles contained within the plurality of tiles are further organized into a plurality of consonant tiles, a plurality of vowel tiles and a wild card tile;

wherein the plurality of consonant tiles is a rectangular plate structure upon which a consonant selected from the English alphabet is displayed;

wherein the plurality of vowel tiles is a rectangular plate structure upon which a vowel selected from the English alphabet is displayed;

wherein the wild card tile is a rectangular plate structure upon which the phrase "wild card" is displayed;

wherein during game play it is declared what letter the wild card tile represents;

wherein the plurality of tiles comprises 36 tiles;

wherein the plurality of vowel tiles comprises two tiles that have the letter A printed on it, 3 tiles that have the letter E printed on it, 3 tiles that have the letter I printed on it, 3 tiles that have the letter O printed on it, two tiles that have the letter U printed on it;

wherein the plurality of consonant tiles comprises 20 tiles;

wherein each tile selected from the plurality of consonant tiles has printed on it a consonant selected from the alphabet;

wherein the wild card tile is the $36^{th}$ tile;

wherein the randomizing device is a mechanical device that is used to generate a first random number and a second random number;

wherein the randomizing device comprises a first die and a second die.

2. The game according to claim 1 wherein the cell at the intersection of the first column and the first row has a decorative element displayed on it;

wherein the cell at the intersection of the eighth column and the first row has a decorative element displayed on it;

wherein the cell at the intersection of the first column and the eighth row has a decorative element displayed on it;

wherein the cell at the intersection of the eighth column and the eighth row has a decorative element displayed on it;

wherein the symbol on the cell at the intersection of the second column and the first row is a number that designates the location of a first playing column selected from the plurality of playing columns;

wherein the cell at the intersection of the third column and the first row is a number that designates the location of a second playing column selected from the plurality of playing columns;

wherein the cell at the intersection of the fourth column and the first row is a number that designates the location of a third playing column selected from the plurality of playing columns;

wherein the cell at the intersection of the fifth column and the first row is a number that designates the location of a fourth playing column selected from the plurality of playing columns;

wherein the cell at the intersection of the sixth column and the first row is a number that designates the location of a fifth playing column selected from the plurality of playing columns;

wherein the cell at the intersection of the seventh column and the first row is a number that designates the location of a sixth playing column selected from the plurality of playing columns;

wherein the cell at the intersection of the second column and the eighth row is a number that designates the location of a first playing column selected from the plurality of playing columns;

wherein the cell at the intersection of the third column and the eighth row is a number that designates the location of a second playing column selected from the plurality of playing columns;

wherein the cell at the intersection of the fourth column and the eighth row is a number that designates the location of a third playing column selected from the plurality of playing columns;

wherein the cell at the intersection of the fifth column and the eighth row is a number that designates the location of a fourth playing column selected from the plurality of playing columns;

wherein the cell at the intersection of the sixth column and the eighth row is a number that designates the location of a fifth playing column selected from the plurality of playing columns;

wherein the cell at the intersection of the seventh column and the eighth row is a number that designates the location of a sixth playing column selected from the plurality of playing columns;

wherein the cell at the intersection of the second row and the first column is a number that designates the location of a first playing row selected from the plurality of playing rows;

wherein the cell at the intersection of the third row and the first column is a number that designates the location of a second playing row selected from the plurality of playing rows;

wherein the cell at the intersection of the fourth row and the first column is a number that designates the location of a third playing row selected from the plurality of playing rows;

wherein the cell at the intersection of the fifth row and the first column is a number that designates the location of a fourth playing row selected from the plurality of playing rows;

wherein the cell at the intersection of the sixth row and the first column is a number that designates the location of a fifth playing row selected from the plurality of playing rows;

wherein the cell at the intersection of the seventh row and the first column is a number that designates the location of a sixth playing row selected from the plurality of playing rows;

wherein the cell at the intersection of the second row and the eighth column is a number that designates the location of a first playing row selected from the plurality of playing rows;

wherein the cell at the intersection of the third row and the eighth column is a number that designates the location of a second playing row selected from the plurality of playing rows;

wherein the cell at the intersection of the fourth row and the eighth column is a number that designates the location of a third playing row selected from the plurality of playing rows;

wherein the cell at the intersection of the fifth row and the eighth column is a number that designates the location of a fourth playing row selected from the plurality of playing rows;

wherein the cell at the intersection of the sixth row and the eighth column is a number that designates the location of a fifth playing row selected from the plurality of playing rows;

wherein the cell at the intersection of the seventh row and the eighth column is a number that designates the location of a sixth playing row selected from the plurality of playing rows.

3. The game according to claim 2 wherein to set the game up for play, the plurality of vowel tiles and the wild card tile are positioned in the following cells of the coordinate board;

wherein at the initial set up of the game the cell at the intersection of the seventh column and the second row receives a tile selected from the plurality of vowel tiles that contains the letter A;

wherein at the initial set up of the game the cell at the intersection of the seventh column and the third row receives a tile selected from the plurality of vowel tiles that contains the letter E;

wherein at the initial set up of the game the cell at the intersection of the seventh column and the fourth row receives a tile selected from the plurality of vowel tiles that contains the letter I;

wherein at the initial set up of the game the cell at the intersection of the seventh column and the fifth row receives a tile selected from the plurality of vowel tiles that contains the letter O;

wherein at the initial set up of the game the cell at the intersection of the seventh column and the sixth row receives a tile selected from the plurality of vowel tiles that contains the letter U;

wherein at the initial set up of the game the cell at the intersection of the seventh row and the second column receives a tile selected from the plurality of vowel tiles that contains the letter A;

wherein at the initial set up of the game the cell at the intersection of the seventh row and the third column receives a tile selected from the plurality of vowel tiles that contains the letter E;

wherein at the initial set up of the game the cell at the intersection of the seventh row and the fourth column receives a tile selected from the plurality of vowel tiles that contains the letter I;

wherein at the initial set up of the game the cell at the intersection of the seventh row and the fifth column receives a tile selected from the plurality of vowel tiles that contains the letter O;

wherein at the initial set up of the game the cell at the intersection of the seventh row and the sixth column receives a tile selected from the plurality of vowel tiles that contains the letter U;

wherein at the initial set up of the game the cell at the intersection of the seventh column and the seventh row receives the wild card tile.

4. The game according to claim 3 wherein the first die and the second die are rolled;

wherein a first selected die is selected from the group consisting of the first die and the second die;

wherein the remaining in the group consisting of the first die and the second die after the selection of the first selected die is designated the second selected die;

wherein the number indicated by the first selected die represents a column selected from the plurality of playing columns;

wherein the number indicated by the second selected die represents a row selected from the plurality of playing rows;

wherein a cell from the plurality of playing cells that is identified by the selected column and the selected row;

wherein if the selected cell is occupied by a first tile selected from the plurality of tiles the first tile is retrieved with a second tile selected from the plurality of tiles;

wherein the completion of a word of five letters or more in a row designates the winner.

5. The game according to claim 4 wherein the coordinate board further comprises a turntable;

wherein the turntable is a slewing bearing that is mounted on the rotating surface of the panel.

6. The game according to claim 4 wherein the game further comprises a plurality of stands;

wherein each of the plurality of stands is a pedestal upon which each of the plurality of tiles such that the tiles placed on the plurality of stands are visible to one player selected from the plurality of players but are not visible to the remaining players contained within the plurality of players.

7. The game according to claim 4 wherein the coordinate board further comprises a turntable;

wherein the game further comprises a plurality of stands;

wherein the turntable is a slewing bearing that is mounted on the rotating surface of the panel;

wherein each of the plurality of stands is a pedestal upon which each of the plurality of tiles such that the tiles placed on the plurality of stands are visible to one player selected from the plurality of players but are not visible to the remaining players contained within the plurality of players.

* * * * *